US008572987B2

(12) United States Patent
Carlisle

(10) Patent No.: US 8,572,987 B2
(45) Date of Patent: Nov. 5, 2013

(54) FUEL INJECTOR MOUNTING SYSTEM

(75) Inventor: Michael L Carlisle, Derby (GB)

(73) Assignee: Rolls-Royce PLC, London (GB)

( * ) Notice: Subject to any disclaimer, the term of this patent is extended or adjusted under 35 U.S.C. 154(b) by 482 days.

(21) Appl. No.: 12/905,549

(22) Filed: Oct. 15, 2010

(65) Prior Publication Data

US 2011/0088409 A1 Apr. 21, 2011

(30) Foreign Application Priority Data

Oct. 19, 2009 (GB) ..... 0918169.4

(51) Int. Cl.
*F02C 7/20* (2006.01)

(52) U.S. Cl.
USPC ..... 60/796

(58) Field of Classification Search
USPC ..... 60/740, 742, 746, 748, 796, 798, 800, 60/772; 239/283, 390, 397, 600
See application file for complete search history.

(56) References Cited

U.S. PATENT DOCUMENTS

| | | | | |
|---|---|---|---|---|
| 2,422,214 | A * | 6/1947 | Meyer et al. | 60/740 |
| 3,116,606 | A * | 1/1964 | Dougherty et al. | 60/39.826 |
| 3,398,529 | A * | 8/1968 | Schmitz et al. | 60/796 |
| 3,879,940 | A * | 4/1975 | Stenger et al. | 60/737 |
| 4,870,826 | A * | 10/1989 | Daguet et al. | 60/751 |
| 5,197,288 | A * | 3/1993 | Newland et al. | 60/734 |
| 5,365,738 | A * | 11/1994 | Etheridge | 60/742 |
| 7,225,996 | B2 * | 6/2007 | Kobayashi et al. | 239/88 |
| 7,827,795 | B2 * | 11/2010 | Hicks et al. | 60/728 |
| 2003/0046935 | A1 * | 3/2003 | Halila et al. | 60/737 |
| 2007/0033940 | A1 * | 2/2007 | Duverneuil et al. | 60/743 |
| 2007/0137218 | A1 | 6/2007 | Prociw et al. | |

OTHER PUBLICATIONS

British Search Report issued in British Application No. 0918169.4 on Feb. 11, 2010.

* cited by examiner

*Primary Examiner* — Phutthiwat Wongwian
(74) *Attorney, Agent, or Firm* — Oliff & Berridge, PLC

(57) ABSTRACT

A combustor is provided for mounting a fuel injector to a gas turbine engine. The combustor comprises an engine casing having an aperture formed therein. The system further comprises a fuel injector having a flange for mounting the fuel injector to the casing at the aperture so that the fuel injector extends into the engine. The flange is dismountably sealed to an inner side of the casing. The aperture and flange are configured so that, when dismounted, the fuel injector can be rotated into an orientation relative to the aperture which allows the flange to pass though the aperture and the fuel injector to be withdrawn from the casing.

15 Claims, 5 Drawing Sheets

(i)

(h)

(g)

FUEL INJECTOR MOUNTING SYSTEM

The present invention relates to a system for mounting a fuel injector to a gas turbine engine.

BACKGROUND

Fuel is delivered to the combustion chamber(s) of a gas turbine engine by one or more fuel injectors.

Fuel injectors for aircraft gas turbine engines are often mounted externally of a casing of the combustion chamber at respective apertures through the casing. Each injector has a mounting flange which is sealingly connected to the external surface of the casing with a feed arm and tip of the injector passing through the aperture and the tip engaging into the head of the combustion chamber. Bolts secure the flange via threads in the casing.

However, a problem with this arrangement is that the securing bolts are working against the casing internal pressure. More particularly, the pressure difference across the casing may be in the range from about 35 to 4100 kPa, with the high pressure within the casing forcing the injector flange away from the casing. This can cause air leakage, and hence engine efficiency loss. On the other hand, an advantage of the arrangement is that the injector can be removed on-wing for maintenance or replacement.

An alternative arrangement has the injector flange sealingly connected to the internal surface of the casing. This overcomes the air leakage problem because the sealing arrangement is working with the internal pressure, i.e. the pressure difference across the casing forces the flange toward the casing. However, the internally mounted injector cannot be easily removed as the flange is too large to be withdrawn through the aperture. Thus the injector can only be removed from the inside, which requires a major engine strip, rendering on-wing maintenance or replacement effectively impossible.

SUMMARY

Thus there is a need to provide a system for mounting a fuel injector to a gas turbine engine which facilitates on-wing removal of the injector while reducing air leakage.

Accordingly, a first aspect of the present invention provides a system for mounting a fuel injector to a gas turbine engine, the system comprising an engine casing having an aperture formed therein and a fuel injector having a flange for mounting the fuel injector to the casing at the aperture so that the fuel injector extends into the engine;

wherein the flange is dismountably sealed to an inner side of the casing and the aperture and flange are configured so that when dismounted the fuel injector can be rotated into an orientation relative to the aperture which allows the flange to pass though the aperture and the fuel injector to be withdrawn from the casing.

With the exception of fluid (eg fuel) flow through the injector, the combination of the flange and ring can close off the aperture. Advantageously, the system combines an internal mounting arrangement for the injector, which can reduce air leakage, with an ability to withdraw the injector through the aperture, which facilitates on-wing removal of the injector.

The system may have any one or, to the extent that they are compatible, any combination of the following optional features.

The aperture may be non-circular and have a major dimension and the flange may be correspondingly non-circular having a major dimension which is longer than the major dimension of the aperture such that the flange covers the aperture when the flange is sealed to the inner side of the casing with major dimension aligned with each other, and wherein a further dimension of the flange is shorter than the major dimension of the aperture such that the fuel injector can be rotated into an orientation in which the further dimension of the flange is aligned with the major dimension of the aperture allowing the flange to pass though the aperture and the fuel injector to be withdrawn from the casing.

The aperture may have a slot at a side of the aperture which locally increases the dimension of the aperture the slot being sufficiently wide to allow the flange to pass through the slot when the fuel injector is rotated into said orientation.

The flange may have a tab at a side thereof which covers the slot when the flange is sealed to the inner side of the casing.

The slot may have a centre line which is angled p relative to a line normal to the casing, the angle p is about 35 degrees.

The slot may have a centre line which is angled p relative to a line normal to the casing, the angle p includes and is between 10 and 50 degrees.

The injector may comprise a feed arm that extends through the flange, the feed arm is is off-set from a central position of the flange by a distance along a major or a further dimension.

The feed arm may have a centre-line that is angled q relative to a line that is normal to the flange.

The angle q may be about 10 degrees.

The angle (q) may be up to and including 30 degrees.

The aperture and flange may be configured so that the rotation of the fuel injector to bring it into said orientation relative to the aperture includes a rotation by approximately 90° about a radial direction of the engine passing though the flange.

The engine casing may have a plurality of apertures each having a respective fuel injector.

A further aspect of the invention provides an engine casing of the first aspect.

A further aspect of the invention provides a fuel injector of the first aspect.

In another aspect of the present invention there is provided a method of assembling and/or disassembling a combustor comprising a fuel injector and a casing, the combustor comprising an engine casing having an aperture formed therein, and a fuel injector having a flange for mounting the fuel injector to the casing at the aperture so that the fuel injector extends into the engine wherein the flange is dismountably sealed to a radially inner side of the casing, wherein the aperture is non-circular and has a major dimension and the flange is correspondingly non-circular having a major dimension which is longer than the major dimension of the aperture such that the flange covers the aperture when the flange is sealed to the inner side of the casing with major dimension aligned with each other, and wherein a further dimension of the flange is shorter than the major dimension of the aperture, the method comprising the steps of rotating the fuel injector into an orientation in which the further dimension of the flange is aligned with the major dimension of the aperture, passing the flange though the aperture.

BRIEF DESRIPTION OF THE DRAWINGS

Embodiments of the invention will now be described by way of example with reference to the accompanying drawings in which.

Figure 1:
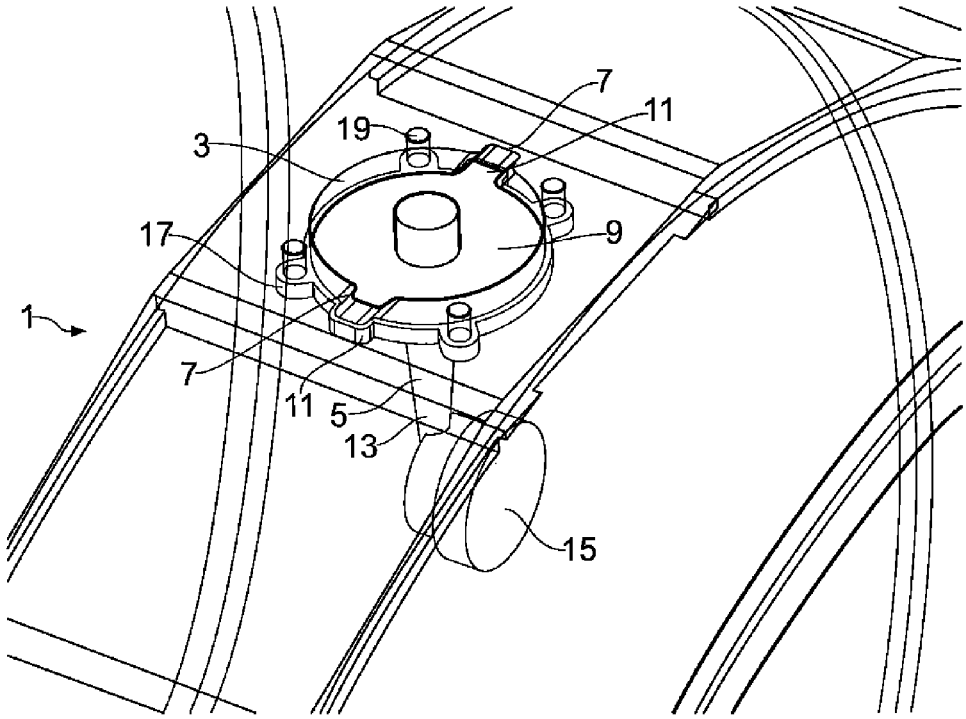
FIG. 1 shows a schematic perspective view of a system for mounting a fuel injector to a gas turbine engine according to the present invention.
Figure 3:
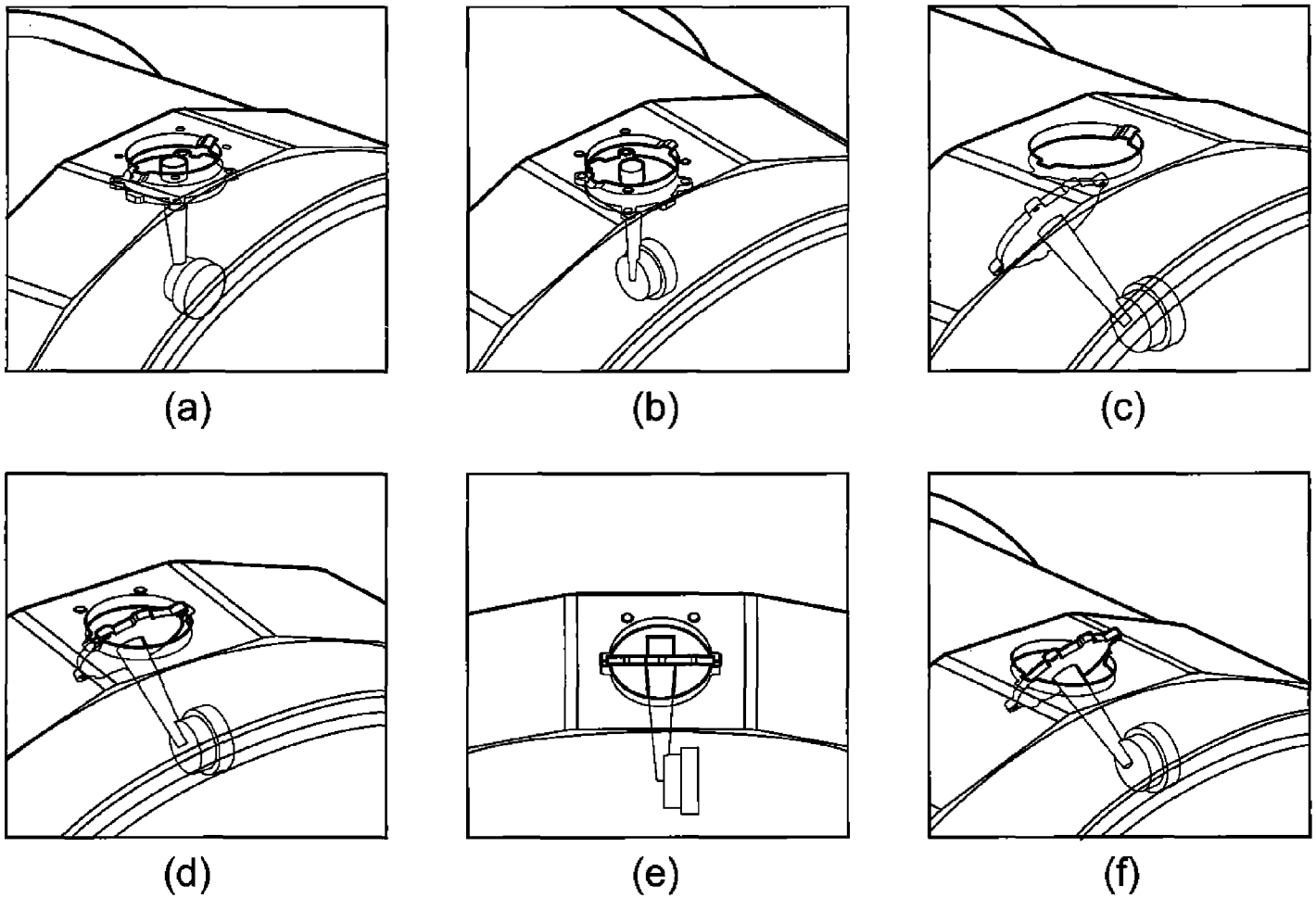
Figure 3:
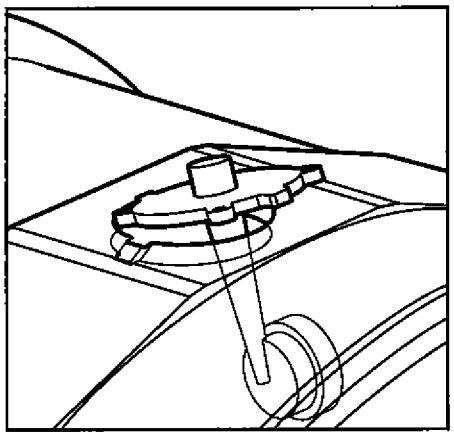
Figure 3:
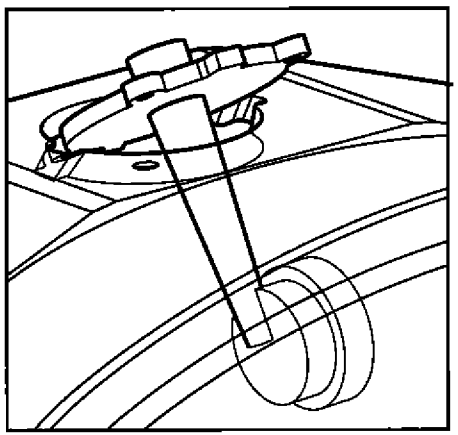
Figure 3:
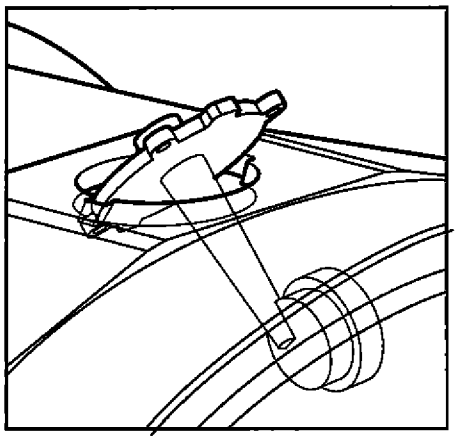
Figure 4:
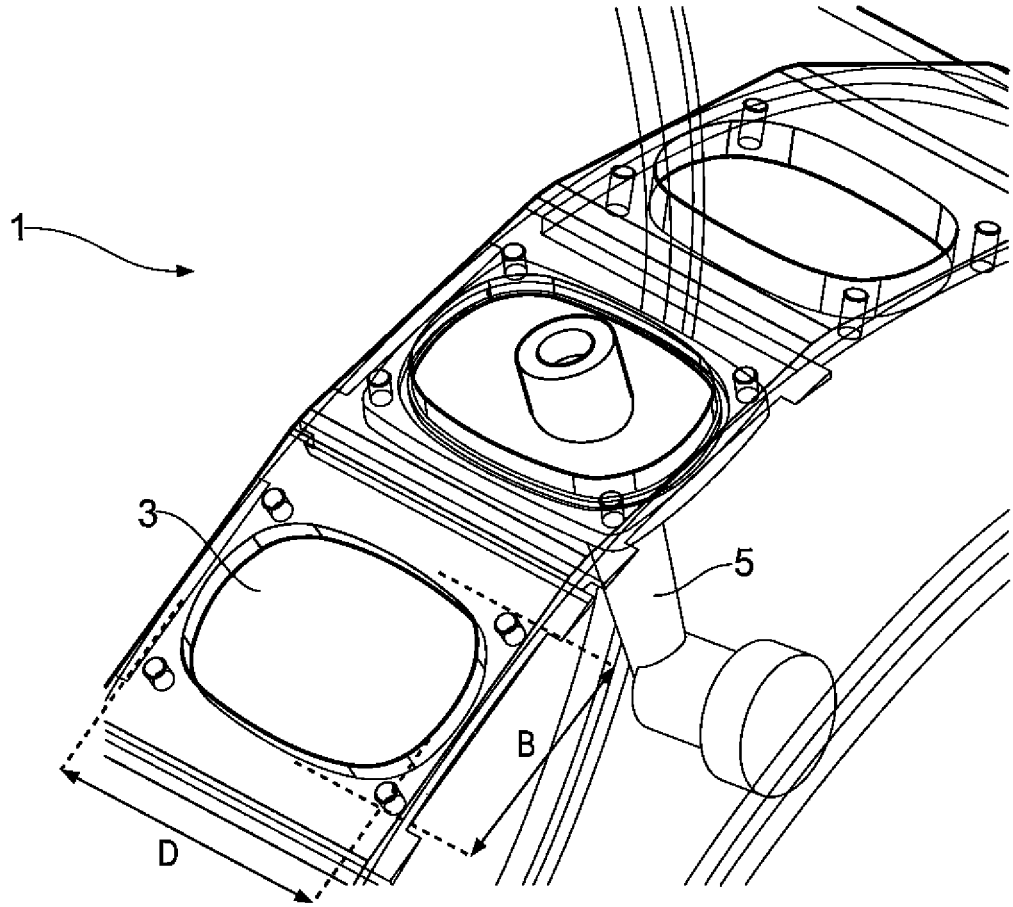
Figure 5:
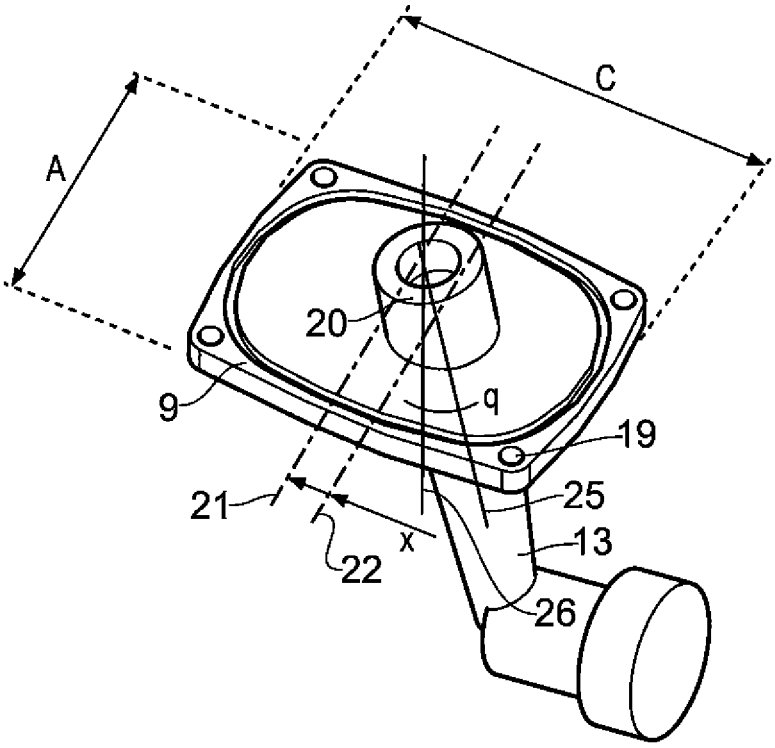

FIG. 3(*a*) to (*i*) show successive steps in the removal of the fuel injector from the casing of FIG. 1;

FIG. 4 shows a schematic perspective view of a system for mounting a fuel injector to a gas turbine engine according to a second aspect of the present invention; and FIG. 5 is a perspective view of the fuel injector shown in FIG. 4.

DETAILED DESRIPTION OF EMBODIMENTS

FIG. 1 shows a schematic perspective view of a system for mounting a fuel injector to a gas turbine engine according to the present invention.

An engine casing 1 (shown partially transparent) has a plurality of circumferentially spaced, largely circular apertures 3. Each aperture is the mounting position for a fuel injector 5 such as a fuel spray nozzle, and has at its edge a pair of diametrically opposed slots 7.

The nozzle 5 has a flange 9 which is also largely circular. The diameter of the circle described by the flange is greater than that described by the aperture 3. A pair of diametrically opposed tabs 11 at the edge of the flange correspond with the positions of the slots 7.

To mount the nozzle 5 to the casing 1, the nozzle is positioned within the casing, with the feed arm 13 and tip 15 of the nozzle extending from the aperture 3 into the engine so that the tip engages with the head of a combustion chamber (not shown). The flange 9 covers the aperture, with the tabs 11 covering the slots 7.

The flange 9 has four regularly spaced projections 17 with central holes which receive a set of bolts (not shown). The bolts pass through corresponding holes 19 in the casing 1 to sealingly fasten the flange to an inner side of the casing. A C-seal (not shown) may be used to improve the sealing of the flange to the casing. The heads of the bolts face outwardly, allowing the bolts to be fastened and unfastened from the outside of the casing. Different numbers of bolts and/or non-regular bolt spacing pattern may be used. If additional clamping load is required, after the nozzle is mounted an external bridge can be fixed over the aperture, the bridge carrying additional bolts which fasten to the flange.

Although bolts may be used to secure the flanges and casing together; integral screw-threaded bosses may be provided on the spaced projections 17. Alternatively, captured bolts may be used such that their screw-thread length that is exposed can be retracted or lengthened for installation of the injector and fixing to the casing.

Figure 2:
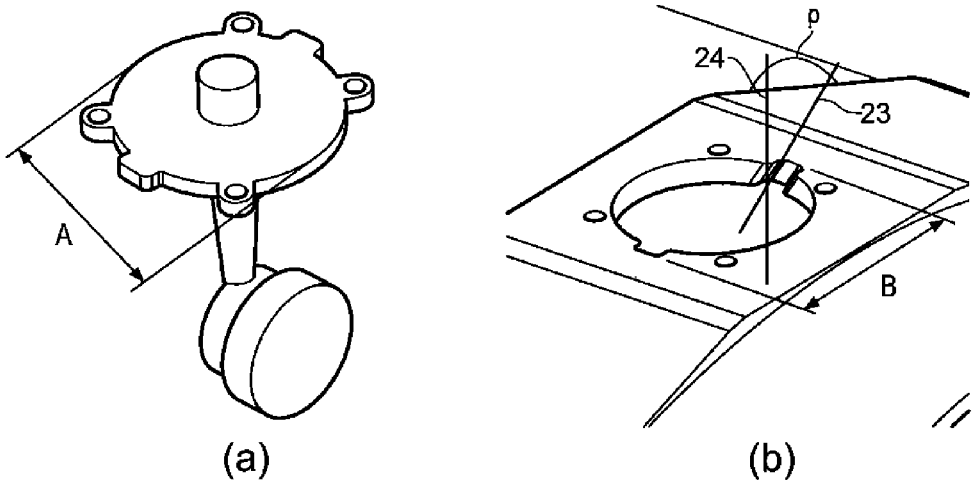
FIG. 2 are perspective views of (*a*) the fuel injector, and (*b*) a casing of the engine of FIG. 1.

FIG. 2(*a*) is a perspective view of the fuel spray nozzle 5, and FIG. 2(*b*) is a perspective view of the casing 1 and aperture 3. The dimension A indicated on FIG. 2(*a*) is a minor diameter of the flange 9. The dimension B indicated on FIG. 2(*b*) is a major diameter of the aperture 9. A major diameter of the flange 9 (i.e. from side at the tabs 11) is longer than dimension B so that the flange fully covers the aperture. Significantly, having dimension B greater than dimension A allows the fuel injector to be rotated into an orientation from which the flange can be passed though the aperture and the fuel injector withdrawn from the casing.

Another aspect of the present invention is a method of assembling and removing the fuel injector to a casing. It should be appreciated that although only the removal steps are described the reverse steps will be immediately apparent to the skilled addressee and are intended to be part of the present invention. Successive steps in the removal of the nozzle 5 from the casing 1 are illustrated in FIG. 3(*a*) to (*i*). Firstly the bolts fastening the flange 9 to the inner side of the casing are removed (FIG. 3(*a*)). Next the nozzle is rotated by 90° about the radial direction of the engine passing through the centre of the flange (FIG. 3(*b*)). The nozzle is tilted about an axis perpendicular to the radial direction such that the flange is aligned with the slots 7 (FIG. 3(*c*)). The flange can then be passed through the aperture with the sides of the flange at the ends of dimension A travelling though the slots (FIG. 3(*d*) to (*i*)). The slots, having a centre line 24, are angled p relative to a line 23 normal to the casing, which in this case is also the radial direction of the engine and casing. This is in contrast to the slots being aligned with the radial direction, the angle of the slots determining the amount by which the nozzle must be tilted (FIG. 3(*c*)). The angling is helpful for preventing the feed arm 13 and tip 15 of the nozzle from interfering with other components of the engine. The slots 7 effectively act as a guide through which the flange passes. In one example the angle p is about 35 degrees, but angles p between 0 and 50 degrees are possible depending on particular combustor and fuel injector configurations. It should be noted that depending on configuration the slots may be angled 'rearwardly' as shown and also in the opposite sense or forwardly and therefore the angle p may be +/−35 degrees and a preferable range between and including 0 and +/−50 degrees.

The procedure allows the nozzle to be removed while the engine remains on-wing. To remount the nozzle to the casing, the removal procedure is reversed.

A suitably configured tool can facilitate the removal of the nozzle 5 from the casing 1. For example, a nozzle tool can be screwed into an inlet thread of the nozzle 5, allowing the nozzle to be securely held from outside the casing when it is manoeuvred as shown in FIG. 3(*a*) to (*i*).

With the flange 9 being mounted internally, on the radially inwardly facing surface of the casing, the system can significantly reduce leakage flow through the aperture 3 because the internal pressure within the combustor forced the flange against the casing. This increases sealing around the injector, which can benefit engine efficiency, and reduce temperatures outside the casing 1. This configuration also means that the fixtures securing the injector to the casing are in compression rather than tension and can be made less robust and therefore lighter in weight.

In FIGS. 1 to 3, the slots 7 are shown in the "North-South" position and aligned in the engine's and combustor's axial direction, and the tabs 11 are at the same "North-South" position when the nozzle 5 is mounted. However, for some engines it may be advantageous to locate the slots and tabs at the "East-West" position, to aid removal, depending on the exact geometry of the casing 1, nozzle, combustor, surrounding constraints etc.

Another variant of the mounting system has only one slot 7 and one tab 11, rather than pairs of slots and tabs.

Advantageously, because the slot or slots 7, which define the major diameter of the aperture 3, accommodate the passage of the flange 7 through the aperture, the other dimensions of the aperture only need to be sufficiently large to allow the passage of the other, smaller parts of the nozzle 5, such as the tip 15, through the aperture. Indeed, in a further variant of the mounting system, the slot or slots 7 can be configured to accommodate the tip, as well as the flange, allowing further reductions in the other dimensions of the aperture. In this way local stress concentrations caused by the aperture can be reduced.

A second embodiment of the present invention is shown in FIGS. 4 and 5, where like features are given the same reference numbers as in the foregoing figures. FIG. 4 is a perspective view of one of the fuel spray nozzles 5 in situ and the casing 1 is shown partially transparent. The casing 1 defines apertures 3 having minimum and maximum dimensions B and D respectively, which in this embodiment are in the circumferential and axial directions respectively.

FIG. 5 is a perspective view on the injector 5 showing the flange 9 having a minimum dimension A and a maximum dimension C. The minimum dimension A of the flange is smaller than the maximum dimension D of the aperture and is larger than the minimum dimension B of the aperture. The maximum dimension C of the flange is larger than the maximum dimension D of the aperture. Therefore the flange 9 fully covers the aperture 3 when in situ. Significantly, having dimension B greater than dimension A allows the fuel injector to be rotated into an orientation from which the flange can be passed though the aperture and the fuel injector inserted and/or withdrawn from the casing.

Referring now to FIG. 5 which shows the fuel injector; in this embodiment the feed arm 13 is off-set from a central position of the flange 9 by a distance X. Line 21 represents the centre line of the flange and line 22 is the centre-line of feed arm. The off-set X is along dimension C and when the fuel injector is in situ the off-set is generally in the axial direction of the engine and combustor. Although a fuel injector with a centrally positioned feed arm can be inserted into the aperture in most cases, in some circumstances it is advantageous to have an off-set feed arm as shown here to provide additional. After the injector tip 15 and feed arm below the flange has been inserted, the smaller portion of dimension C of the flange can be inserted more easily through the aperture and similarly the larger portion of dimension C may be fed out of the aperture first when extracting the fuel injector.

In the preferred embodiment shown in FIGS. 4 and 5, the off-set X is approximately 10% of the relative flange dimension, but dependent on combustor architecture and injector size the off-set X could be between and including −30% and +30%. Therefore it should be appreciated that the off-set may be either forward of the flange centre-line as shown in FIGS. 4 and 5 or rearward and indeed either side of the centre-point on the flange. The off-set may also be a combination of either forward or rearward and sideways of the flange's centre-point.

To further assist inserting and extracting the fuel injector to the aperture, the feed arm, having a centre-line 25, is angled q degrees relative to a line 24 that is normal to the flange such that its tip 15 is forwardly displaced (to the right on FIG. 5). The angle q is preferably about 10 degrees although depending on combustor configuration a range of angles between 0 and 25 degrees are possible and advantageous. It should be appreciated that the angle q may be 'forwardly' as shown in FIGS. 4 and 5 or 'rearwardly' and indeed it is also possible for the angle q to be relative to a lateral angle of the feed arm although angles of q might be more usually between and including 0 and 15 degrees.

The invention claimed is:

1. A combustor for a gas turbine engine, the combustor comprising:

an engine casing having an aperture formed therein, and a fuel injector having a flange for mounting the fuel injector to the engine casing at the aperture so that the fuel injector extends into the gas turbine engine, wherein the flange is dismountably sealed to an inner side of the casing, and when dismounted, the fuel injector is rotatable into an orientation relative to the aperture to pass the flange through the aperture to withdraw the fuel injector though the aperture from the inside to the outside of the engine casing.

2. A combustor according to claim 1, wherein the aperture is non-circular and has a major dimension;

the flange is correspondingly non-circular and has a major dimension which is longer than the major dimension of the aperture;

the flange covers the aperture when the flange is sealed to the inner side of the engine casing with the major dimension of the aperture and the major dimension of the flange aligned with each other;

a further dimension of the flange is shorter than the major dimension of the aperture; and the fuel injector is rotatable into an orientation in which the flange's further dimension is aligned with the aperture's major dimension allowing the flange to pass through the aperture to withdraw the fuel injector from the engine casing.

3. A combustor according to claim 1, wherein the aperture has a slot at a side of the aperture which locally increases a dimension of the aperture to allow the flange to pass through the slot when the fuel injector is rotated into said orientation.

4. A combustor according to claim 3, wherein the flange has a tab at a side thereof which covers the slot when the flange is sealed to the inner side of the engine casing.

5. A combustor according to claim 3, wherein the slot has a centre line which is angled p relative to a line normal to the engine casing, the angle p is about 35 degrees.

6. A combustor according to claim 3, wherein the slot has a centre line which is angled p relative to a line normal to the engine casing, the angle includes and is between 10 and 50 degrees.

7. A combustor according to claim 1, wherein the injector comprises a feed arm that extends through the flange, the feed arm is off-set from a central position of the flange by a distance along a major or a further dimension.

8. A combustor according to claim 1, wherein the feed arm has a centre-line that is angled relative to a line that is normal to the flange.

9. A combustor according to claim 8, wherein the centre-line is angled at about 10 degrees relative to the line that is normal to the flange.

10. A combustor according to claim 8, wherein the centre-line is angled up to and including 30 degrees relative to the line that is normal to the flange.

11. A combustor according to claim 1, wherein the aperture and the flange are configured so that the rotation of the fuel injector to bring the fuel injector into said orientation relative to the aperture includes a rotation by 90° about a radial direction of the gas turbine engine passing through the flange.

12. A combustor according to claim 1, wherein the engine casing has a plurality of apertures each having a respective fuel injector.

13. An engine casing of claim 1.

14. A fuel injector of claim 1.

15. A method of assembling and/or disassembling a combustor, the combustor comprising an engine casing having an aperture formed therein, and a fuel injector having a flange for mounting the fuel injector to the engine casing at the aperture so that the fuel injector extends into the engine wherein the flange is dismountably sealed to a radially inner side of the engine casing, wherein the aperture is non-circular and has a major dimension and the flange is correspondingly non-circular and has a major dimension which is longer than the major dimension of the aperture such that the flange covers the aperture when the flange is sealed to the inner side of the engine casing with the major dimension of the aperture and the major dimension of the flange aligned with each other, and wherein a further dimension of the flange is shorter than the major dimension of the aperture, the method comprising the steps of:

rotating the fuel injector into an orientation in which the further dimension of the flange is aligned with the major dimension of the aperture, and passing the flange through the aperture.

* * * * *